US009027975B2

(12) United States Patent
Meyer et al.

(10) Patent No.: US 9,027,975 B2
(45) Date of Patent: May 12, 2015

(54) METHOD FOR REPLACING A TRANSFORMER IN A WIND ENERGY INSTALLATION

(75) Inventors: Ewald Meyer, Holtland (DE); Arnim Gerbers, Aurich (DE)

(73) Assignee: Wobben Properties GmbH, Aurich (DE)

( * ) Notice: Subject to any disclaimer, the term of this patent is extended or adjusted under 35 U.S.C. 154(b) by 0 days.

(21) Appl. No.: 13/877,437

(22) PCT Filed: Oct. 4, 2011

(86) PCT No.: PCT/EP2011/067311
§ 371 (c)(1),
(2), (4) Date: Jun. 14, 2013

(87) PCT Pub. No.: WO2012/045741
PCT Pub. Date: Apr. 12, 2012

(65) Prior Publication Data

US 2013/0259633 A1 Oct. 3, 2013

(30) Foreign Application Priority Data

Oct. 4, 2010 (DE) ..... 10 2010 041 940

(51) Int. Cl.
*B66C 1/10* (2006.01)

(52) U.S. Cl.
CPC ..... *B66C 1/105* (2013.01); *B66C 1/108* (2013.01)

(58) Field of Classification Search
USPC ..... 294/68.3, 67.1, 81.1, 81.3, 81.4, 81.52, 294/68.26, 67.32, 67.5; 414/10, 11; 212/231, 347
See application file for complete search history.

(56) References Cited

U.S. PATENT DOCUMENTS

| | | | | |
|---|---|---|---|---|
| 3,675,961 | A * | 7/1972 | Wheeler | 294/67.1 |
| 3,973,754 | A * | 8/1976 | Chadwick, Jr. | 414/460 |
| 4,017,109 | A * | 4/1977 | Belinsky | 294/67.21 |
| 4,251,098 | A * | 2/1981 | Belinsky | 294/67.21 |
| 4,433,830 | A * | 2/1984 | Campbell | 294/67.2 |
| 4,671,721 | A * | 6/1987 | Pratt et al. | 294/67.1 |
| 7,017,963 | B1 | 3/2006 | Setzke et al. | |
| 7,895,744 | B2 * | 3/2011 | Numajiri | 254/334 |
| 8,317,244 | B1 * | 11/2012 | Schuyleman | 294/67.5 |
| 2007/0200103 | A1 * | 8/2007 | Viladomiu i Guarro et al. | 254/334 |
| 2010/0028152 | A1 | 2/2010 | Numajiri et al. | |
| 2014/0001782 | A1 * | 1/2014 | Leibovitz | 294/67.5 |

FOREIGN PATENT DOCUMENTS

| | | | |
|---|---|---|---|
| AU | 458237 | B2 | 12/1973 |
| DE | 3211390 | A1 | 9/1983 |

(Continued)

*Primary Examiner* — Paul T Chin
(74) *Attorney, Agent, or Firm* — Seed IP Law Group PLLC

(57) ABSTRACT

A method of replacing a generator of a wind power installation. The generator is provided in the interior of a pylon of a wind power installation and the pylon has a door opening. An exchanging cross beam is fixed by way of a first fastening point to a crane hook of a mobile crane. A first end of the cross beam is introduced with a second fastening point through the door opening into the pylon. The transformer to be replaced is fixed to the second fastening point of the first end. A compensating weight is fixed at the second fastening point to the second end of the cross beam. The second end of the cross beam is tilted or inclined until the transformer is at the height of the door opening and the crane hook is moved until the transformer to be replaced is outside the door opening.

14 Claims, 4 Drawing Sheets

(56) References Cited

FOREIGN PATENT DOCUMENTS

| | | | | | |
|---|---|---|---|---|---|
| DE | 102008035350 | A1 | 2/2010 | | |
| FR | 2843952 | * | 8/2002 | ..... | B66C 1/10 |
| FR | 2 843 952 | A1 | 3/2004 | | |
| GB | 1 379 889 | A | 1/1975 | | |
| JP | 2004-067355 | A | 3/2004 | | |
| SU | 922026 | A1 | 4/1982 | | |

* cited by examiner

METHOD FOR REPLACING A TRANSFORMER IN A WIND ENERGY INSTALLATION

BACKGROUND

1. Technical Field

The present invention concerns a method of replacing a transformer of a wind power installation.

2. Description of the Related Art

In modern wind power installations transformers are typically provided in the lower region of the pylon of a wind power installation. The transformers can be used to transform an output voltage of a power cabinet of a wind power installation into a voltage required for an electrical network to which the wind power installation is connected.

The transformers typically have only a limited service life so that, during the service life of the wind power installation, it can happen that a transformer has to be replaced. Typically, special mobile cranes with heavy-duty tips were utilized to replace the transformers. In that case a crane jib can be moved through a door opening into the pylon of the wind power installation to connect to the transformer and lift it out. As the dimensions of the door openings are limited a crane jib with a heavy duty tip is used.

As general state of the art attention is directed to DE 32 11 390 A1 and DE 10 2008 350.

BRIEF SUMMARY

One or more embodiments of the present invention is to provide a method of replacing a transformer of a wind power installation, in which a special crane is not required.

There is provided a method of replacing a generator of a wind power installation. In one embodiment the generator is provided in the interior of a pylon of a wind power installation and the pylon has a door opening. An exchanging cross beam is fixed by way of a first fastening point to a crane hook of a mobile crane. A first end of the cross beam is introduced with a second fastening point through the door opening into the pylon. The transformer to be replaced is fixed to the second fastening point of the first end. A compensating weight is fixed at the second fastening point to the second end of the cross beam. The weight of the compensating weight can optionally substantially correspond to the weight of the transformer to be replaced. The second end of the cross beam is tilted or inclined until the transformer is at the height of the door opening and the crane hook is moved until the transformer to be replaced is outside the door opening.

In an aspect of the present invention a new transformer which is to replace the old transformer is provided as the compensating weight and the cross beam is rotated through 180° and the new transformer at the second fastening point at the second end of the cross beam is guided into the door opening.

In a further aspect of the invention the new transformer is lowered into the operative position by the first end of the cross beam being raised or the cross beam being tilted.

In a further aspect of the invention a first and a second block-and-tackle can be respectively connected to the first fastening point and the second end of the cross beam, in which case then the second end is moved up or down by means of the second block-and-tackle so that the cross beam can be tilted or inclined.

In a further aspect of the invention there is provided a further first fastening point for the cross beam. While the first fastening point is provided at the center of gravity of the cross beam the further first fastening point is provided outside the center of gravity so that it is also possible to handle loads of differing weights at the first and second ends of the cross beam.

One or more embodiments of the present invention concern an exchanging cross beam for use in a method of replacing the transformer. The cross beam has an elongate body, a first fastening point for receiving a crane hook of a crane, and a respective second fastening point at the first and second ends of the cross beam for respectively receiving a transformer to be replaced and a compensating weight. The first fastening point is disposed substantially at the center of gravity of the cross beam.

One embodiment is directed to providing a method of replacing a transformer of a wind power installation, wherein there are provided a cross beam having a first fastening point for attachment of a crane hook of a crane and two further fastening points to which the transformer to be replaced and a compensating weight can be fastened. To replace the defective transformer to be replaced, an end of the cross beam is introduced into the door opening of a pylon of the wind power installation and the transformer to be replaced is attached to the fastening point. The second end of the cross beam then projects out of the pylon and a compensating weight such as for example the new transformer can be attached at the second fastening point. If the compensating weight is of substantially the same weight as the generator to be replaced then the cross beam is held substantially in equilibrium and the transformer to be replaced can be lifted out of the door opening. Optionally the compensating weight can be in the form of the new transformer so that the cross beam only has to be rotated through 180° and the new transformer can be introduced through the door opening. If then the replaced transformer is lifted it can be provided that the cross beam is tilted and the new transformer can be transported to its position.

Optionally the cross beam can be provided with a further first fastening point so that the crane hook can be coupled to the further first fastening point. That further first fastening point is not provided at the center of gravity of the cross beam so that it is also possible to use compensating weights which do not correspond to the weight of the transformer to be replaced. That is the case for example when the new transformer is lighter or heavier than the transformer to be replaced.

BRIEF DESCRIPTION OF THE SEVERAL VIEWS OF THE DRAWINGS

Advantages and embodiments by way of example of the invention are described in greater detail hereinafter with reference to the drawings.

DETAILED DESCRIPTION

Figure 1:
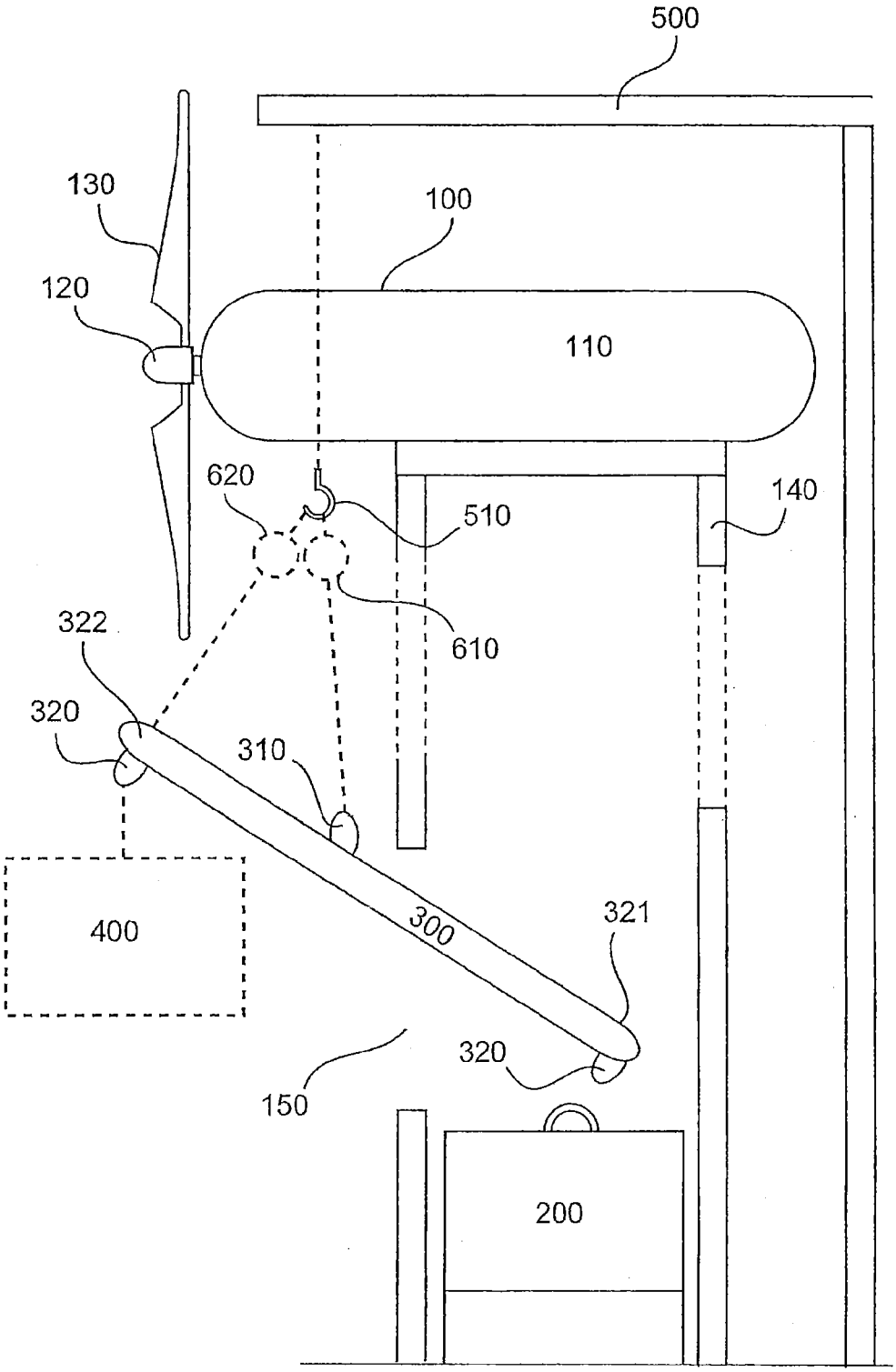
FIG. 1 shows a diagrammatic view of a wind power installation and a cross beam when replacing a transformer of the wind power installation according to a first embodiment.

FIG. 1 shows a diagrammatic view of a wind power installation with a crane for replacing a transformer of the wind power installation according to a first embodiment. The wind power installation 100 has a pod 110, a rotor 120 having a plurality of rotor blades 130 and a pylon 140 having a door opening 150. A transformer 200 is in the lower region of the pylon 140. FIG. 1 also shows a crane 500 and a crane hook 510 that is attached to an exchanging cross beam 300.

The cross beam 300 has a first fastening point 310 for receiving a crane hook 510 of the crane 500 and two second fastening points 320 at the first and second ends 321, 322 of the cross beam 300. The second fastening point 320 serves to receive a transformer 200 to be replaced, and a compensating weight 400.

If the transformer 200 of the wind power installation 100 is defective then the cross beam 300 is fixed with the first fastening point 310 to a crane hook 510 and a first end 321 of the cross beam 300 with a second fastening point 320 is introduced through the door opening 150. The transformer 200 can then be fixed to a second fastening point 320 of the first end 321. A compensating weight 400 can be fastened at the other second fastening point 320 at the second end 322. Preferably the weight of the compensating weight 400 substantially corresponds to the weight of the transformer 200 to be replaced. Optionally the new transformer can be used as the compensating weight 400. If the transformer 200 is provided beneath the door opening 150 the first end 321 of the cross beam 300 can firstly be introduced through the door opening 150 and then tilted or inclined, then the transformer 200 can be fixed to the second fastening point 320 at the first end 321 and the second end 322 of the cross beam with the compensating weight 400 can be tilted or inclined so that the transformer 200 at the first end 321 can be moved upwardly and can then be lifted through the door opening 150.

If the new transformer is to be provided as the compensating weight 400 at the second end 322 of the cross beam 300 then the cross beam 300 only has to be rotated through 180° and the new transformer can be passed through the door opening 150 and the second end 322 of the cross beam 300 can be tilted to move the transformer 300 into its position.

Optionally a first and/or second block-and-tackle 610, 620 can be provided or coupled to the crane hook 510. The first block-and-tackle 610 can be coupled to the first fastening point 630. The second block-and-tackle 620 can be coupled to the second end 322 of the cross beam. The second end 322 of the cross beam 300 can be raised or lowered by the second block-and-tackle 620 so that the cross beam in itself can be tilted or inclined.

The first and second block-and-tackle 610, 620 can be connected by way of a first and a second round sling to the first fastening point 310 and the second end 320.

The method of replacing a defective transformer makes it possible to dispense with a special crane having a heavy duty tip. Thus, a standard mobile crane can be used to replace the defective transformer.

The method of replacing a defective transformer can be used in relation to steel pylons which provide the door opening above the position of installation of the transformer. Alternatively thereto however the method according to the invention can also be used in relation to concrete pylons.

One method according an embodiment of the invention is particularly advantageous if the transformer is provided beneath the door opening in the pylon of the wind power installation.

Figure 2:
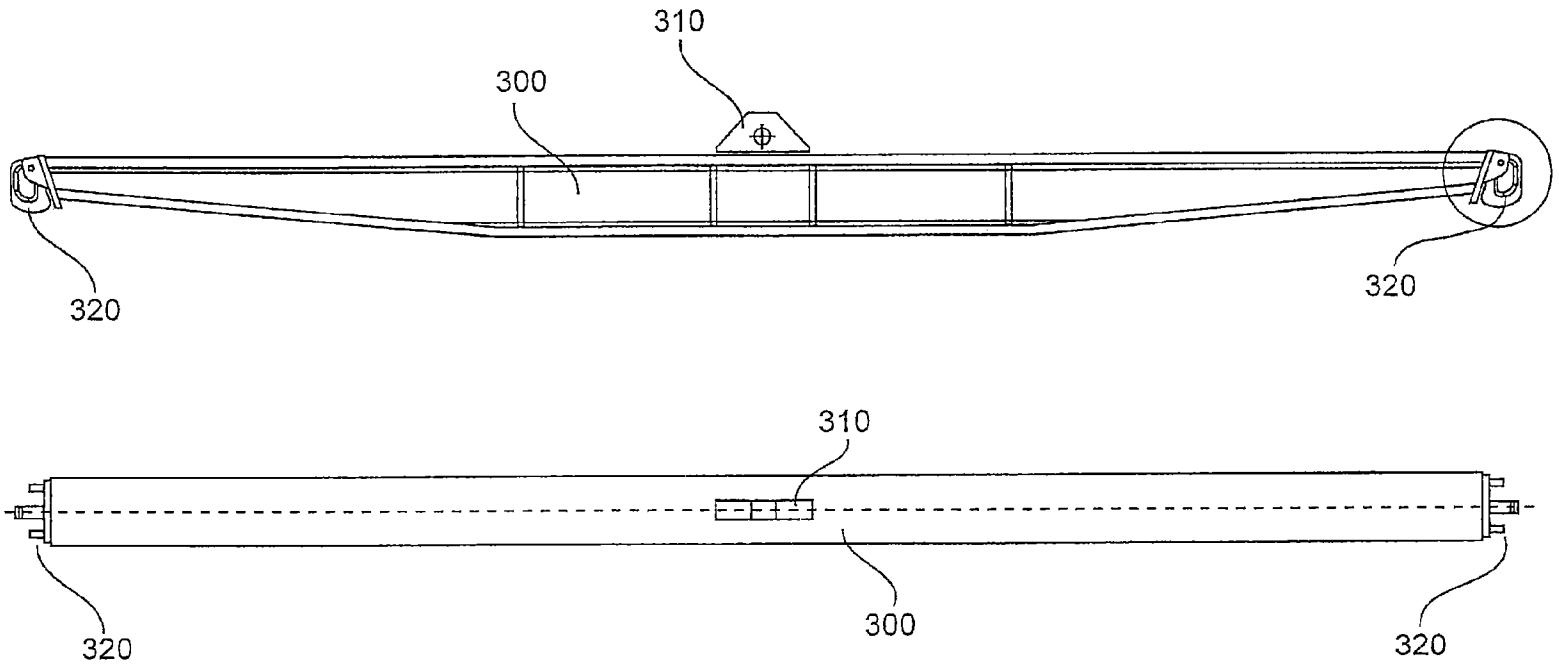
FIG. 2 shows a diagrammatic plan view of a cross beam according to a second embodiment.

FIG. 2 shows a diagrammatic view of a cross beam according to a second embodiment. The cross beam of the second embodiment can be used in accordance with the first embodiment. The cross beam 300 has a first fastening point 310 for receiving a crane hook. At its first and second ends the cross beam has a respective second fastening point 320 for receiving the transformer 200 to be replaced and for receiving a compensating weight 400. The cross beam 300 is so designed that it can bear both the weight of the transformer 200 to be replaced and also the compensating weight 400.

Figure 3:
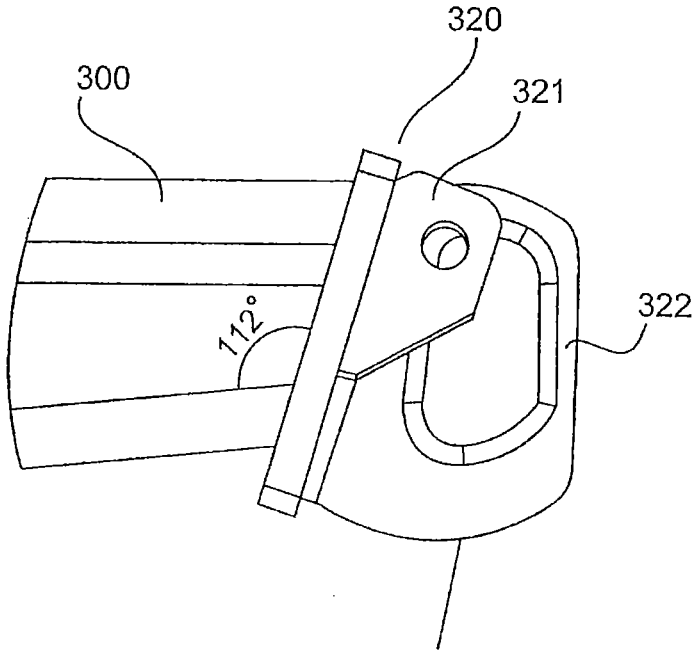
FIGS. 3 and 4 show various views of a fastening point of the cross beam of FIG. 2.
Figure 4:
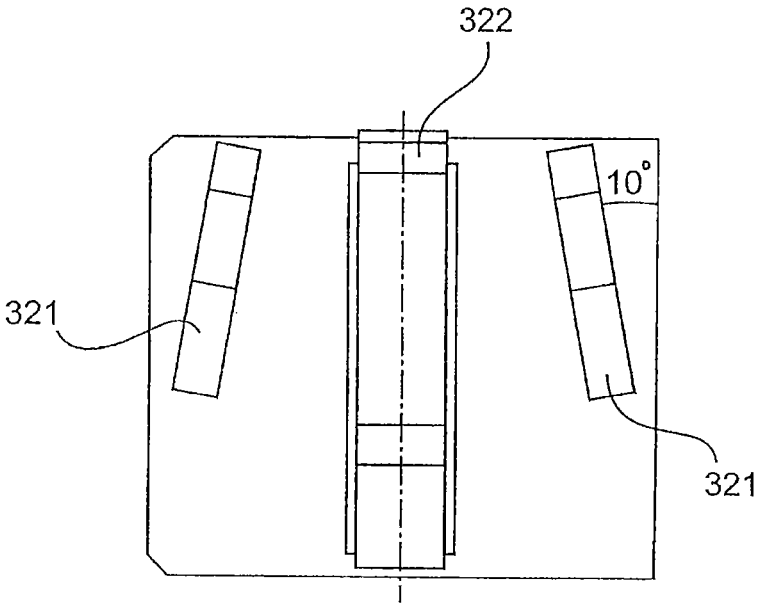

FIGS. 3 and 4 show a side view and a plan view of the end of the cross beam having a respective second fastening point 320. Two plates 321 each having a hole are provided at the end of the cross beam 300. There is also a further plate 322 having a larger hole.

Figure 5:
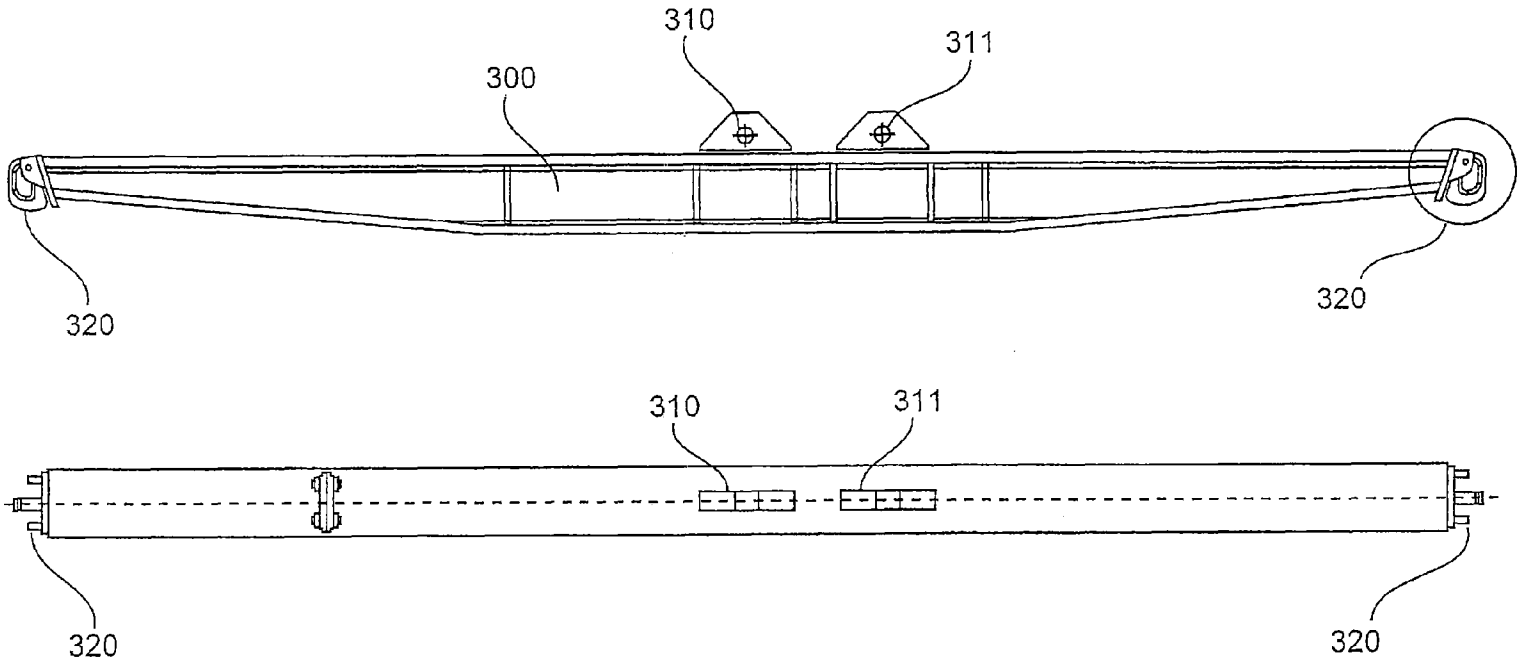
FIG. 5 shows a diagrammatic plan view of a cross beam according to a third embodiment.

FIG. 5 shows a diagrammatic plan view of a cross beam in accordance with a third embodiment. In this case the cross beam according to the third embodiment substantially corresponds to the cross beam of FIG. 2. In addition to the optional first fastening point 310, the cross beam of the third embodiment has a further first fastening point 311. Optionally further first fastening points can be provided. The first fastening point 310 can be used if the compensating weight which is fastened to the second end substantially corresponds to the weight of the transformer to be replaced. The further first fastening point 311 can be used if the weight of the compensating weight does not substantially correspond to the weight of the transformer to be replaced. In that case the compensating weight can for example be in the form of the new transformer, in which case the new transformer can be both heavier and also lighter.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of replacing a first transformer of a wind power installation using an exchanging cross beam, the method comprising:

coupling a first fastening device of the cross beam to a crane hook of a crane;

introducing a first end of the cross beam through a door opening of a pylon, the first end having a second fastening device;

fastening the second fastening device to the first transformer;

securing a second transformer to a third fastening device at the second end of the cross beam;

tilting or inclining the second end of the cross beam until the first transformer is at a height of the door opening;

moving the crane hook so that the transformer is moved through the door opening;

rotating the cross beam 180°; and moving the second transformer through the door opening and into the pylon.

2. The method according to claim 1 further comprising raising or tilting the first end of the cross beam so that the second transformer is lowered into an operating position in the pylon.

3. The method according to claim 1 further comprising removing the first fastening device from the crane hook and coupling the second fastening device to the crane hook.

4. An exchanging cross beam for replacing a first transformer of a wind power installation with a second transformer, the cross beam comprising:

an elongate body having a first end and a second end;

a first fastening device secured to the elongate body for receiving a crane hook of a crane; and a second fastening device at the first end of the elongate body;

a first transformer coupled to the second fastening device;

a third fastening device at the second end of the elongate body; and a second transformer coupled to the third fastening device, the elongate body being configured to rotate 180°.

5. The cross beam according to claim 4 wherein the first fastening device is provided substantially at the center of gravity of the elongate body.

6. The cross beam according to claim 4 further comprising a third fastening device that is located on the elongate body a distance from the center of gravity of the elongate body.

7. The cross beam according to claim 4 wherein the second fastening devices are openings at the respective ends of the elongate body.

8. The cross beam according to claim 4 wherein the compensating weight is a transformer.

9. A method comprising:

securing a first fastening device of an exchanging cross beam to a crane hook of a crane;

securing a first end of the cross beam to a first transformer to be removed through a door opening of a pylon;

securing a second end of the cross beam to a second transformer;

moving the transformer through the door opening;

after moving the first transformer through the door opening, rotating the cross beam 180°; and moving the second transformer through the door opening and into the pylon.

10. The method of claim 9 wherein securing a first end of the cross beam to a transformer occurs before securing a second end of the cross beam to a compensating weight.

11. The method of claim 9 wherein the compensating weight has a weight that substantially correspondence to the weight of the transformer.

12. The method of claim 9 further comprising tilting the second end of the cross beam such that the transformer is aligned with the door opening before moving the transformer through the door opening.

13. The method of claim 9 wherein securing the first end of the cross beam to the transformer comprises securing the first end of the cross beam to the transformer via a second fastening device located on the first end of the cross beam and wherein securing the second end of the cross beam to the compensating weight comprises securing the second end of the cross beam to the compensating weight via a third fastening device located on the second end of the cross beam.

14. The method according to claim 9 further comprising raising or tilting the first end of the cross beam so that the second transformer is lowered into an operating position in the pylon.

* * * * *